US008708106B2

(12) United States Patent
Räsänen et al.

(10) Patent No.: US 8,708,106 B2
(45) Date of Patent: Apr. 29, 2014

(54) ELEVATOR ARRANGEMENT AND METHOD IN ELEVATOR MAINTENANCE

(75) Inventors: Matti Räsänen, Hyvinkää (FI); Teemu Tolonen, Aura (FI); Jaakko Kahila, Karkkila (FI); Mauno Mattila, Hyvinkää (FI); Jouni Lappalainen, Jokela (FI)

(73) Assignee: Kone Corporation, Helsinki (FI)

( * ) Notice: Subject to any disclaimer, the term of this patent is extended or adjusted under 35 U.S.C. 154(b) by 367 days.

(21) Appl. No.: 12/969,241

(22) Filed: Dec. 15, 2010

(65) Prior Publication Data

US 2011/0083926 A1 Apr. 14, 2011

Related U.S. Application Data

(63) Continuation of application No. PCT/FI2009/000059, filed on Jun. 16, 2009.

(30) Foreign Application Priority Data

Jun. 30, 2008 (FI) ..... 20080425

(51) Int. Cl.

| | |
|---|---|
| ***B66B 5/16*** | (2006.01) |
| ***B66B 5/28*** | (2006.01) |
| ***B66B 1/36*** | (2006.01) |

(52) U.S. Cl.

USPC ..... 187/356; 187/302; 187/357

(58) Field of Classification Search

USPC ..... 187/300, 311, 312, 357, 360, 302, 356, 187/343

IPC ..... B66B 5/08,5/16, 5/26, 5/28

See application file for complete search history.

(56) References Cited

U.S. PATENT DOCUMENTS

| | | | | | |
|---|---|---|---|---|---|
| 255,646 | A * | 3/1882 | McCarroll | ..... | 187/356 |
| RE10,127 | E * | 5/1882 | McCarroll | ..... | 187/356 |
| 277,226 | A * | 5/1883 | Carscadin et al. | ..... | 187/356 |
| 3,674,113 | A * | 7/1972 | Richmon | ..... | 187/394 |
| 5,680,911 | A | 10/1997 | Wang | | |
| 6,273,216 | B1 * | 8/2001 | Kocher et al. | ..... | 187/377 |
| 6,478,117 | B2 * | 11/2002 | Swaybill | ..... | 187/305 |
| 7,278,517 | B2 | 10/2007 | Gut | | |
| 2003/0106747 | A1 * | 6/2003 | Sasaki | ..... | 187/373 |
| 2007/0181378 | A1 * | 8/2007 | Kigawa et al. | ..... | 187/376 |

FOREIGN PATENT DOCUMENTS

| | | | | |
|---|---|---|---|---|
| EP | 2 795 060 | A1 | 12/2000 | |
| EP | 1 422 182 | A1 | 5/2004 | |
| EP | 1 473 264 | A1 | 11/2004 | |
| EP | 1 604 934 | A1 | 12/2005 | |
| EP | 1 674 416 | A1 | 6/2006 | |
| WO | WO 2006062503 | A1 * | 6/2006 | ..... B66B 5/02 |

* cited by examiner

*Primary Examiner* — Michael Mansen
*Assistant Examiner* — Stefan Kruer
(74) *Attorney, Agent, or Firm* — Birch, Stewart, Kolasch & Birch, LLP

(57) ABSTRACT

An elevator arrangement, comprising an elevator car arranged to move in an elevator shaft or equivalent, preferably along car guide rails, and an element which is disposed in the elevator shaft or equivalent and is shiftable between an activated state and an inactivated state, and an activating device for shifting the said element between the activated and inactivated states. The activating device includes a flexible element, such as e.g. a rope or equivalent, movably attached to a fixed structure of the elevator shaft or equivalent, and the said flexible element is connected to the said shiftable element in a manner permitting the shiftable element to be shifted by means of the flexible element.

20 Claims, 2 Drawing Sheets

ELEVATOR ARRANGEMENT AND METHOD IN ELEVATOR MAINTENANCE

CROSS REFERENCE TO RELATED APPLICATIONS

Figure 1:
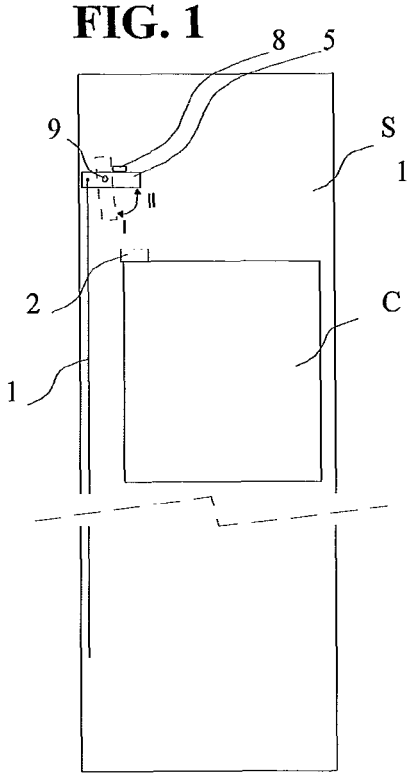

This application is a Continuation of PCT International Application No. PCT/FI2009/000059 filed on Jun. 16, 2009, which claims the benefit of Patent Application No. 20080425 filed in Finland, on Jun. 30, 2008. The entire contents of all of the above applications is hereby incorporated by reference into the present application.

FIELD OF THE INVENTION

The present invention relates to an elevator arrangement and to a method in elevator maintenance.

BACKGROUND OF THE INVENTION

There are various prior-art elevator safety devices which can be used to create a temporary safety space at the end of an elevator shaft. The commonest arrangement for this purpose is to use mechanical stoppers arranged to stop the elevator car and prevent it from moving all the way to the end of the elevator shaft. In prior art, this is proposed to be implemented using e.g. at least one movable mechanical stopper attached to the elevator shaft and arranged to be moved into the path of a mechanical stopper attached to the elevator car. In this type of solutions, when the stoppers in the elevator shaft are in an activated state, the elevator car can only move until the aforesaid mutually aligned stoppers meet, preventing the elevator car from moving further. In this way, the movement of the elevator car can be restricted e.g. for as long as a serviceman is working on the top of the elevator car or on the bottom of the elevator shaft. Otherwise the serviceman would be liable to being squeezed between the elevator car and the end of the elevator shaft. In alternative solutions, a movable stopper is attached to the elevator car, from the top of which it can be activated by moving it to a position which, as seen in the direction of motion of the car, is aligned with an immovable stopper fixed in place in the elevator shaft. Prior art is described inter alia in patent publications EP1473264, EP1604934, EP1674416A1 and FR2795060A1.

One of the problems involved in prior-art solutions is that the stoppers have to be activated from a position in their vicinity. For this reason, the person activating the stoppers consequently has to be at a certain location in the elevator shaft. Moreover, the movable stoppers must be activated one by one. Especially in safety equipment solutions where expressly the stoppers in the elevator shaft are movable, it is difficult to activate the stoppers in a simple and fast manner because the stoppers are often placed at a large distance from each other. Thus, for example, in order to activate a safety device, the serviceman has had to get to the bottom floor, open the landing door with a service key and move the stopper in the elevator shaft pit manually to an activated position. To activate the upper safety device, the serviceman has had to get to the top of the elevator car in order to activate the stopper.

OBJECT OF THE INVENTION

The object of the invention is to overcome i.a. some of the above-mentioned drawbacks of prior-art solutions. The invention aims at producing advantages including one or more of the following:

- A number of stoppers and/or switches in an elevator shaft or equivalent can be activated at a time.
- A serviceman can activate a stopper/switch or a number of stoppers/switches that is/are not in his vicinity.
- The serviceman need not be at a certain location in order to activate the stoppers and/or switches in the elevator shaft or equivalent.
- Stoppers and/or switches attached to the elevator shaft or equivalent can be activated from a landing door opening without entering the elevator shaft. The stopper(s) and/or switches can preferably be activated even from the door openings of landings at which no elevator car is present in the elevator shaft at the moment of activation and which are located at a considerable distance from the shaft bottom.
- A reliable and safe working space in a desired part of the elevator shaft is achieved.
- Safe and simple simultaneous activation of the stoppers and/or switches in the elevator shaft is achieved.
- An elevator arrangement whose safety device can be safely activated is achieved.

BRIEF DESCRIPTION OF THE INVENTION

Inventive embodiments are presented in the description part and drawings of the present application. The inventive content disclosed in the application can also be defined in other ways than is done in the claims below. The inventive content of the application can also be defined in other ways than those used in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. The features of different embodiments of the invention can be applied in connection with other embodiments within the scope of the basic inventive concept.

One of the objects of the present invention is to achieve an arrangement that will allow a shiftable element, such as e.g. a stopper, sensor, switch or the like, to be shifted from one state to another in a manner that does not require the person performing the shifting operation to be in the immediate vicinity of the said element and/or at a given location. According to the invention, the elevator arrangement is provided for this purpose with activating means comprising a flexible element, such as e.g. a rope or equivalent, movably attached to a fixed structure of an elevator shaft or equivalent. The flexible element is connected to the said shiftable element. The shiftable element can thus be shifted by means of the flexible element between an activated state and an inactivated state.

According to the invention, the elevator arrangement comprises an elevator car arranged to move in an elevator shaft or equivalent, preferably along car guide rails, and an element disposed in the elevator shaft or equivalent and arranged to be shiftable between an activated state (II) and an inactivated state (I), and activating means for shifting the said element between the activated (II) and inactivated (I) states. The said activating means comprise a flexible element, such as e.g. a rope or equivalent, movably attached to a fixed structure of the elevator shaft or equivalent, and this flexible element is connected to the said shiftable element in a manner permitting the shiftable element to be shifted by means of the said flexible element.

In an embodiment of the invention, the shiftable element is in the activated state (II) in a first position and in the inactivated state (I) in a second position, this second position being different from the first position, between which first and second positions the shiftable element is arranged to be shifted by moving it by means of the flexible element.

In an embodiment of the invention, the shiftable element is a mechanical stopper.

In an embodiment of the invention, the shiftable element is a safety switch.

In an embodiment of the invention, when the shiftable element is in the activated state (II), the arrangement forms a temporary safety space in a part of the elevator shaft, preferably at the upper and/or lower ends/end.

In an embodiment of the invention, the flexible element is so disposed in the elevator shaft or equivalent that it extends in the traveling direction of the elevator car through a distance corresponding to at least one floor-to-floor distance, preferably at least from a height at the level of one landing door opening to a height at the level of another landing door opening.

In an embodiment of the invention, the flexible element is so disposed in the elevator shaft or equivalent that it extends in the traveling direction of the elevator car through a distance corresponding to at least one floor-to-floor distance, preferably at least from a height located at the level of one landing door opening to a height located at the level of another landing door opening, and that the shiftable element is a mechanical stopper arranged to be shifted between states (I and II) by moving it by means of the flexible element transversely relative to the elevator shaft between the activated position (II), at which the stopper is in alignment with a stopper attached to the elevator car as seen in the direction of motion of the elevator car, and the inactivated position (I), at which the stopper is out of alignment with the stopper attacked to the elevator car.

In an embodiment of the invention, the flexible element is connected to a number of shiftable elements so as to allow them to be shifted simultaneously between the activated state (II) and the inactivated state (I).

In an embodiment of the invention, the flexible element is passed around at least one idle wheel.

In an embodiment of the invention, the flexible element passes around an idle wheel, and the portion of the flexible element on a first side of the idle wheel and the portion (31*b*) of the flexible element on a second side of the idle wheel are attached to an element swivellably mounted on a fixed structure of the elevator shaft or equivalent, said element preferably being a rocker arm or equivalent.

In an embodiment of the invention, the flexible element passes around an idle wheel, and the portion of the flexible element on a first side of said idle wheel is connected to a shiftable element and the portion of the flexible element on a second side of said idle wheel is connected to another shiftable element.

In an embodiment of the invention, at least some of the activating means are attached to a guide rail in the elevator shaft, preferably to a car guide rail.

In an embodiment of the invention, the shiftable element is a mechanical stopper arranged to be moved transversely relative to the elevator shaft between an activated position (II), at which position the stopper is in alignment with the stopper attached to the elevator car as seen in the direction of motion of the elevator car, and an inactivated position (I), at which position the stopper is out of alignment with the stopper attached to the elevator car.

In an embodiment of the invention, the stopper attached to the elevator car is a stopper for activating the safety gear.

In an embodiment of the invention, the flexible element is arranged to run at a close distance from at least one, preferably all of the landing doors, preferably at a distance of below 70 cm from a vertical edge of the landing door opening, to make it possible to move the flexible element manually via an opened landing door.

According to the invention, in a method in elevator maintenance, at least one shiftable element comprised in the elevator is shifted between an inactivated state and an activated state e.g. in order to provide a safety space in at least a part of the elevator shaft. In the method, the shiftable element is shifted by means of a flexible element.

In an embodiment of the invention, the flexible element is so disposed in the elevator shaft or equivalent that it extends in the traveling direction of the elevator car through a distance corresponding to at least one floor-to-floor distance, and that the shiftable element is a mechanical stopper which is shifted between states by moving it by means of the flexible element transversely relative to the direction of the elevator shaft between an activated position, at which the stopper is in alignment with the stopper attached to the elevator car as seen in the direction of motion of the elevator car, and an inactivated position, at which the stopper is out of alignment with the stopper attached to the elevator car.

the flexible element is so disposed in the elevator shaft or equivalent that it extends in the traveling direction of the elevator car at least through a distance corresponding to one floor-to-floor distance, In an embodiment of the method of the invention, the shiftable element is shifted by means of the flexible element by moving the flexible element, from a distance from the shiftable element corresponding to at least one floor-to-floor distance, preferably by moving the flexible element manually by pulling the flexible element in its longitudinal direction.

LIST OF FIGURES

In the following, the invention will be described in detail by referring to a few example embodiments in combination with the attached drawings, wherein FIG. 1 presents a diagrammatic side view of an elevator arrangement according to an embodiment of the invention.

Figure 2:
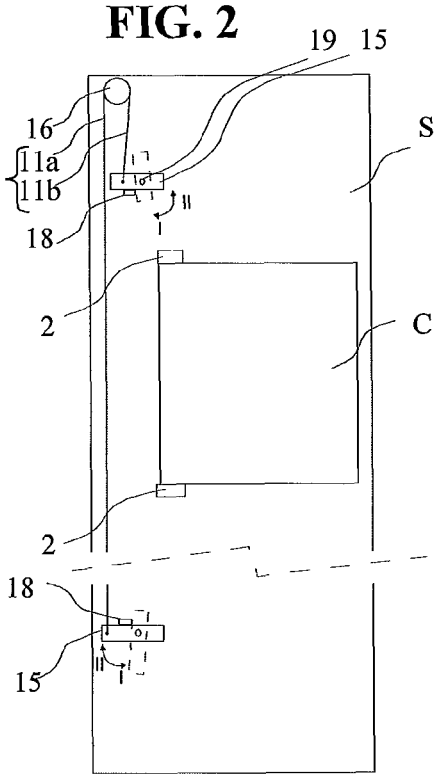

FIG. 2 presents a diagrammatic side view of an elevator arrangement according to a second embodiment of the invention.

Figure 3:
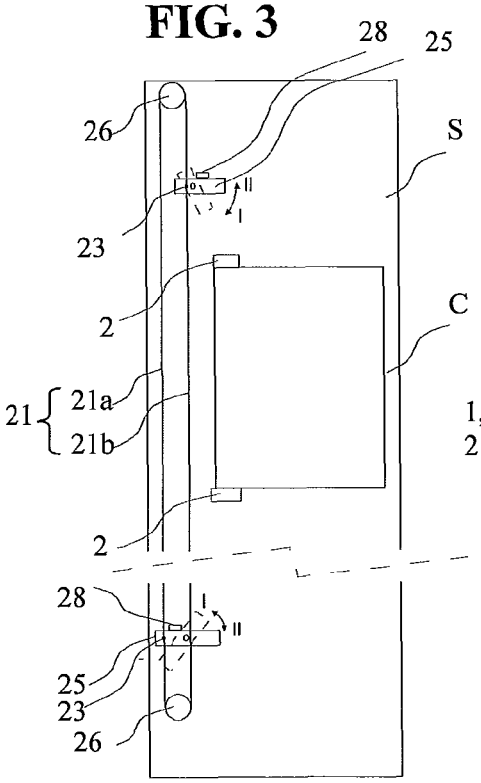

FIG. 3 presents a diagrammatic side view of an elevator arrangement according to a third embodiment of the invention.

Figure 4:
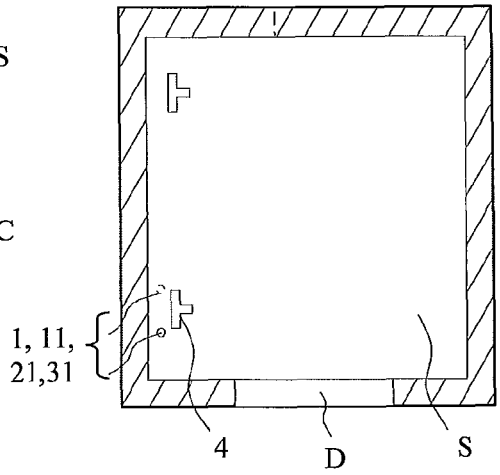

FIG. 4 presents a diagrammatic cross-section of an elevator shaft which is advantageous in the elevator arrangements in the embodiments according to FIGS. 1-3 and 5, inter alia.

Figure 5:
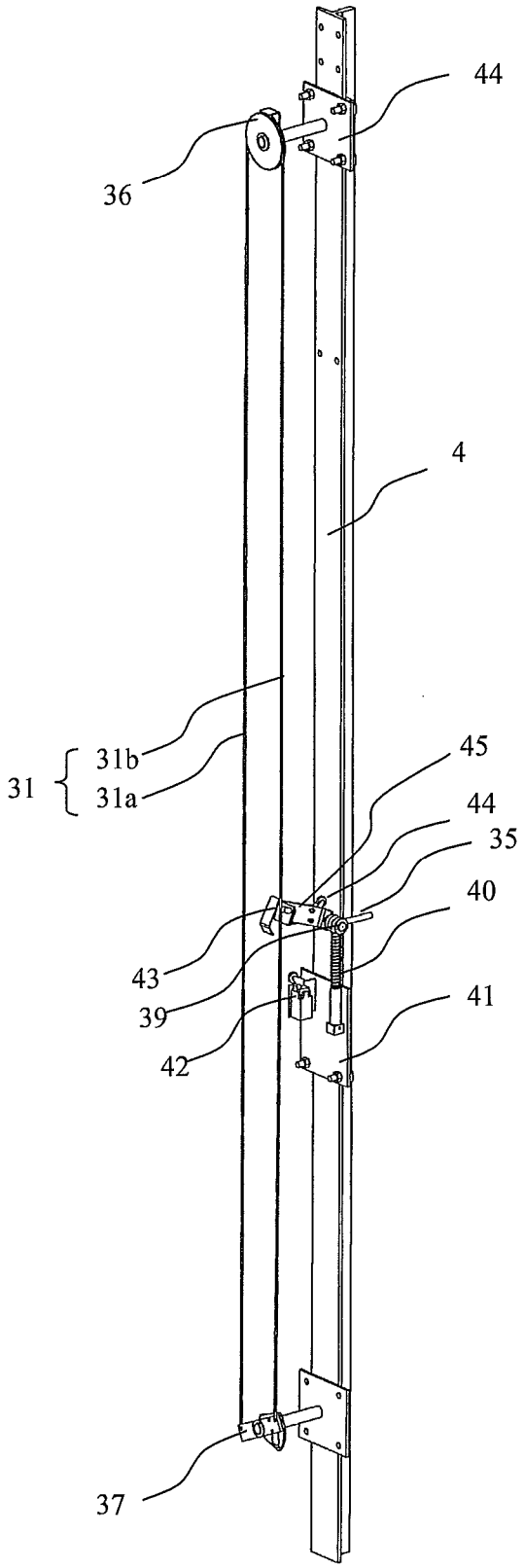

FIG. 5 presents a diagram of an elevator arrangement according to a fourth embodiment of the invention, depicted in three-dimensional view.

DETAILED DESCRIPTION OF THE INVENTION

FIG. 1 represents an arrangement according to an embodiment of the invention. Mounted on a fixed structure of the elevator shaft or equivalent, preferably on a guide rail, is a stopper 5 supported by an axle 9 and swivelable about said axle 9. Attached to the stopper 5 is a flexible element 1, preferably a rope, in such manner that, by pulling at the rope, the stopper 5 can be swiveled from position I, depicted in broken lines, to position II, depicted in solid lines, thus causing a part of the stopper to move transversely relative to the shaft into the path of a stopper 2 attached to the elevator car C, said path extending in a vertical direction in the figure. Correspondingly, when the rope is loosened, the stopper swivels out of the position depicted in the figure due to the weight exerted by its center of gravity. The rope extends from the stopper mounted at the upper end of the shaft S to a level close to the lower end of the shaft, thus allowing the position of the stopper 5 to be changed by means of the rope from the vicinity of the lower end of the shaft, but also from positions along the distance between the stopper and the lower end of the shaft. After the stopper has been shifted to the desired position, it is preferably locked in that position by preventing movement of the rope. This can be effected e.g. by fastening the rope to a hook (not shown) mounted in the shaft. The figure shows only one stopper 5 attached to the rope 1, but the lower end of the rope can additionally be attached to a shiftable stopper provided at the lower end of the shaft.

FIG. 2 represents an arrangement according to a second embodiment of the invention. Mounted on a fixed structure of the elevator shaft or equivalent S, preferably on a guide rail, are shiftable elements, which in the figure are stoppers 15 supported by axles 19 secured to the shaft S, said stoppers 15 being swivelable about said axles 19. Attached to the stoppers 15 is a flexible element 11, which preferably is a rope, so that, by moving the rope 11 in its longitudinal direction by the portion between the stoppers, the stoppers 15 can be swiveled between the activated position II depicted in solid lines in the figure and position I depicted in broken lines, thereby causing a part of each stopper to move transversely relative to the shaft so that it comes into alignment with the path (vertical in the figure) of a stopper 2 attached to the elevator car C or out of alignment with it. There are two stoppers 15 attached to the rope 1. The rope 1 passes around an idle wheel 16 rotatably secured to the shaft S, the part 11*a* of the flexible element on a first side the pulley being attached to a stopper while the part 11*b* of the flexible element on a second side is attached to a second stopper. One of the advantages provided by the idle wheel is that, by moving the rope in one direction, the stoppers at the upper and lower ends of the shaft can be swiveled in mutually opposite directions. This is advantageous because, when a safety space is to be formed at the upper end, it is necessary to be able to stop especially upward movement of the elevator car, and when a safety space is to be formed at the lower end, downward motion has to be stopped.

FIG. 3 represents an arrangement according to a third embodiment of the invention. Mounted on a fixed structure of the elevator shaft or equivalent S, preferably on a guide rail, are shiftable elements in a manner corresponding to that described in connection with the preceding embodiments, said shiftable elements in the figure being stoppers 25 supported by axles 29 and swivelably movable about said axles 29. Attached to the stoppers 25 is a flexible element (connection points 23), which preferably is a rope, so that, by moving the rope 21 in its longitudinal direction by the portion between the stoppers, the stoppers 25 can be swiveled between the activated position II depicted in solid lines in the figure and position I depicted in broken lines, thereby causing a part of each stopper to move transversely relative to the shaft so that it comes into alignment with the path of a stopper 2 attached to the elevator car C or out of alignment with it, which path in the figure extends in a vertical direction. There are two stoppers 25 attached to the rope 21. The rope 21 passes around idle wheels 26 rotatably secured to the shaft S. The part 21*a* of the flexible element on a first side the upper pulley is attached to one stopper while the part 21*b* of the flexible element on a second side is attached to the other stopper. This solution comprises two idle wheels. One of the advantages is that the force exerted by the flexible element on the stoppers due to its weight does not change essentially when the flexible element is being moved, because the rope forms an endless loop. A further advantage is that each stopper can be moved forcibly in both directions by means of the flexible element, and it is not necessary to utilize the center of gravity or to use a spring-loaded arrangement. Alternatively, the arrangement at the lower end in the solution of FIG. 3 could be implemented as illustrated in FIG. 5 (see part 37), this solution also having the aforesaid advantages.

In FIGS. 1-3, the inactivated position I of the stoppers 5, 15 and 25 is indicated by broken lines. In this position, the stopper is out of alignment with the stopper/stoppers 2 attached to the elevator car as seen in the direction of motion of the elevator car C. The range of movement of each stopper is limited by a limiter element 8, 18, 28 attached to a fixed structure of the elevator shaft or equivalent. The limiter elements are fitted in the vicinity of the stoppers 5, 15 and 25 so that they prevent the activated stoppers from moving away from the path of the stopper 2 attached to the elevator car when the stoppers collide as the elevator car is moving towards the end of the elevator shaft S from the direction of its position depicted in the figures. Each stopper is preferably fitted at a distance from the end of the shaft S such that, when the elevator car hits the movable stopper, there remains between the car and the shaft end a space required for safety to ensure that a human being will not be crushed in between.

FIG. 4 represents a cross-section of the elevator shaft at the level of a landing door. The cross-section depicted here is advantageous in the elevator arrangements of all embodiments. The flexible element 1, 11, 21 or 31 is arranged to run close by at least one, preferably all of the landing doors as seen from above in the cross-sectional view of the shaft, preferably at a distance of below 70 cm from a vertical edge (the left edge in the figure) of the landing door opening D, to allow the flexible element to be moved manually via an opened landing door. The upper rope, which is depicted with a broken line in the figure, is not present in the embodiment according to FIG. 1. In the figure, the guide rails are disposed as for a ruck-sack type elevator, but they may also be disposed differently. The essential point is that the rope 1, 21, 22 or 32 is close enough to the landing door opening D to permit the activation to be effected from the opening D.

FIG. 5 represents a solution where a flexible element, preferably a rope 31, passes around an idle wheel 36, and the portion 31*a* of the flexible element on a first side of said idle wheel 36 is connected (connection point 43) by a rod 45 to a shiftable element, which is a stopper 35. The rod 45, to which the stopper 35 is rigidly attached, is mounted on a guide rail 4 in a manner permitting it to swivel about a pivot 39. The portion 31*a* of the flexible element on the first side of the idle wheel 36 and the portion 31*b* of the flexible element on the second side are attached to an element 37 swivelably attached to the guide rail 4, said element being a rocker arm limiting the range of motion of the flexible element.

The figure shows the stopper 35 in the activated position II, in which position the stopper 35 would be in alignment with the stopper (not shown) attached to the elevator car and moving in a direction parallel with the guide rail 4. By moving the rope 31 so that its portion 31*b* moves downwards in the figure, the rod 45 and the stopper 35 attached to it are caused to swivel (counter-clockwise in the figure) about the pivot 39 disposed at the end of a supporting element 40 so that the stopper 35 is shifted into a vertical position away from the path of the stopper attached to the elevator car (not shown). The solution presented in the figure is intended especially for solutions where a safety gear mounted on the elevator car is triggered by a stopper placed in the elevator shaft. Since after the start of safety gear action the elevator car goes on moving through some distance (downwards in the figure), the supporting element 40 is so implemented that it has a play allowing the stopper 35 supported by it to move, being pushed by the stopper attached to the elevator car, in the direction of motion of the elevator car through a certain distance after the stoppers have met. The supporting element 40 is mounted on a plate 41 secured to the guide rail 4 and, in the solution described, comprises telescopingly movable parts and is provided with a spring tending to resist the motion of the stopper 35 as it is pushed by the elevator car. The spring is adapted to have a force sufficient to activate safety gear action. To make safety gear action possible, the stopper attached to the elevator car is connected, preferably via a lever system, to at least one safety gear mounted on the elevator car. Thus, in this arrangement, the stopper 35 can be moved into the activated position II into the path of the stopper attached to the elevator car and connected to the safety gear (not shown).

The solution in FIG. 5 preferably comprises sensors 42 and 44 to permit detection of the state of the stopper 35 based on the position of the rod 45. The sensor 44 attached to the rod 45 preferably comprises a roller which, when in the activated position, is pressed against the guide rail 4. When pressed against the guide rail, the roller transmits data indicating the state of the stopper to the elevator control system. This provides the advantage that the sensor remains activated as the stopper 5 is moving after the stopper attached to the elevator car has hit it.

The solution presented in FIG. 5 is particularly well adapted for creating a safety space at the lower end, because decelerating an elevator car moving downwards requires (especially in the case of elevators without counterweight) more braking power than decelerating an elevator car moving upwards. In the solution described here, the stopper need not be dimensioned according to the braking power required to decelerate the car (and a possible counterweight) but according to the power required to trigger the safety gear. However, the solution is also applicable for use in other types of arrangement besides those described above, e.g. when the stopper attached to the elevator car is not a stopper connected to a safety gear. In this case, it may i.a. be unnecessary to provide the supporting element 40 with vertical play, and the pivot 39 may be secured in a more straightforward manner to a guide rail 4 or some other fixed structure of the elevator. Moreover, it is possible to connect other shiftable stoppers to the rope 31, e.g. a stopper for an upper safety space. The latter stopper is preferably connected to portion 31*a* of the rope, so that the activation direction is reverse to that for the stopper included in the lower safety device, due to the opposite direction of motion of the elevator car.

In all embodiments, the stoppers are preferably each fitted at a distance from the end of the shaft S such that, when the elevator car hits a movable stopper, there remains between the car and the shaft end a space required for safety to ensure that a human being will not be squeezed between them. In the figures, swivelable mechanical stoppers are presented, but each mechanical stopper could also be implemented in some other way. The stopper may be e.g. an element moving back and forth like a slide and arranged to be moved transversely relative to the elevator shaft so that vertical motion of the flexible element in the direction of the elevator shaft is converted into horizontal back-and-forth motion of the stopper by means of pivoted levers provided between the stopper and the flexible element e.g. in a manner corresponding to the way in which longitudinal motion of the timing belt in automobiles is converted by means of a connecting rod and a piston rod into reciprocating motion of the piston. In this embodiment, the limiting elements are preferably placed above and below the stopper, between which limiting elements the stopper can move horizontally back and forth. However, a limiting element may also be placed only above or below the stopper so that the limiting element remains between the stopper and that end of the shaft in whose vicinity the stopper is located.

In all embodiments, the basic state of the position of the stoppers can be chosen to be fail-safe by adapting the center of gravity of each stopper to be so located relative to the pivot of the stopper that the stopper will swivel in the desired direction e.g. if the flexible element is broken. In the figures, the stoppers are depicted in an indicative manner and the center of gravity of each stopper is also its center of surface area. In practice, the position of the gravitational center can be altered e.g. by providing the stopper with weight plates placed on that side of the pivot where the center of gravity is desired to be located. Alternatively, each stopper may be adapted to be tending towards a certain position by the action of a magnet or spring, which provides the advantage that the center of gravity need not be considered. The locking of the flexible element in position can be implemented using any rope locking device. The flexible element may be provided e.g. with loops at landing zones, allowing the locking to be effected by hanging the loop onto a hook, latch or quick-release fastener secured to the elevator shaft. Alternatively, the flexible element need not be locked if the stoppers are locked in position by themselves. For example, magnetic attraction may exist between the limiting element 8, 18 or 28 and the stopper 5, 15 or 25. In this case, at least one of these, either the stopper or the limiter, is magnetic or comprises a magnetic part while the other parts are made of a material subject to magnetic attraction (e.g. iron, steel). The attractive force of the magnet is preferably so adapted that moving the stopper by means of the flexible element to a position close to the limiting element results in magnetic action tending to move the stopper against the limiting element. The force is preferably adapted to be sufficient to hold the stopper in place against the limiting element. By moving the flexible element in this situation, the stopper can be moved substantially away from the range of attraction of the magnet. In addition, the limiting element is preferably arranged to be such that the stopper will behave bistably so that, when the stopper is moved sufficiently far away from the position against the limiting element, magnetic attraction will start pulling the stopper in another direction, which is a reverse direction relative to the previous direction. For this action, a separate limiting element can be provided, but it is not necessary because e.g. in FIG. 3 the stopper 25 swivels in such manner that it meets the limiting element 28 at either extreme position, the magnetic attraction between the stopper and the limiting element being preferably stronger at these extreme positions than when the stopper is between the extreme positions, bistability being thus achieved. A bistable arrangement can also be implemented in other ways, e.g. by using pivotally spring-loaded elements.

In all the above-described solutions, the flexible element preferably extends in the running direction of the elevator car at least through a distance corresponding to one floor-to-floor distance, preferably extending at least from a height at the level of one landing door opening to a height at the level of another landing door opening. Preferably the flexible element extends at least from a height at the level of the topmost landing door opening to a height at the level of the lowest landing door opening.

FIGS. 1-5 are depicted as indicative representations and not in true proportion. For the sake of clarity, the stoppers in FIGS. 2 and 3 are shown as being so arranged that the rotational center axis of the stopper is parallel to the rotational center axis of parts 16 and 26. To save space, the rotational center axis of the stoppers in these embodiments, too, can also be oriented in a different direction, preferably in a manner corresponding to that illustrated in FIG. 5, i.e. in a direction perpendicular to the rotational center axes of the runners. In all embodiments, the mounting of the flexible element in the elevator shaft is preferably implemented by securing it to the guide rails, most preferably partially or completely to the backside of a guide rail, but the flexible element can also be secured to some other fixed structure of the elevator shaft or building.

Not all the features presented in the figures are essential to the functioning of the invention. For example, the mounting and other structures of the stoppers may be implemented according to a prior-art technology. The essential point is that a shiftable element is changed from one positional state to another by means of a flexible element.

The stopper/stoppers mentioned in connection with FIGS. 1-3 and 5 as being attached to the elevator car are depicted in the figures as stoppers fixedly attached to the elevator car (e.g. buffer-type stoppers), but they could alternatively be implemented as movable stoppers (e.g. safety gear activating stopper). In all embodiments (FIGS. 1-5), the stopper 2 attached to the elevator car may be a safety gear activating stopper, in other words, the stopper attached to the elevator car is connected to the safety gear and functions as a trigger activating the safety gear when the stopper attached to the elevator car and the stopper in the elevator shaft meet.

In a method according to the invention, at least one shiftable element comprised in an elevator is shifted between an inactivated state (I) and an activated state (II), e.g. in order to provide a safety space at least in a part of the elevator shaft, by shifting the shiftable element by means of a flexible element. The flexible element (1,11,21,31) is so disposed in the elevator shaft or equivalent that it extends in the traveling direction of the elevator car through a distance corresponding to at least one floor-to-floor distance. The shiftable element (5,15,25, 35) is preferably a mechanical stopper which is shifted between states (I and II) by moving it by means of the flexible element transversely relative to the direction of the elevator shaft between the activated position (II), at which the stopper is in alignment with a stopper attacked to the elevator car as seen in the direction of motion of the elevator car, and an inactivated position (I), at which the stopper is out of alignment with the stopper (2) attached to the elevator car. The flexible element (1,11,21,31) is preferably so disposed in the elevator shaft or equivalent that it extends in the traveling direction of the elevator car through a distance corresponding to at least one floor-to-floor distance. Activation of the stopper can thus be effected from a distance, e.g. from a distance corresponding to at least one floor-to-floor distance from the shiftable element, preferably by moving the flexible element manually by drawing the flexible element in its lengthwise direction. In the method, the arrangement is preferably as described in FIGS. 1-5 and the corresponding explanations.

It is obvious to the a person skilled in the art that the invention is not limited to the embodiments described above, in which the invention has been described by way of example, but that many variations and different embodiments of the invention are possible within the scope of the inventive concept defined in the claims presented below. It is thus obvious that elements other than mechanical stoppers can also be shifted between an activated state and an inactivated state. The flexible element may be connected to the shiftable element mechanically and/or electrically. The essential point is that movement of the flexible element shifts the shiftable element from one state to the other. The state may be e.g. a physical position of a mechanical stopper, a position/state of an electric switch, or it may also be a condition of the entire system (normal condition/service condition). A shiftable element electrically connected to the flexible element could be e.g. an inductive sensor monitoring the flexible element to detect its movement. The effect of activation may in this case correspond to the activation of e.g. a traditional safety switch. In this case, activated state is understood as referring to a situation where the sensor itself has been switched and/or has switched the elevator system from one state to the other, preferably from a normal operation state to a maintenance operation state of a higher safety level. Alternatively, this can also be implemented by attaching to the flexible element an identifier whose motion can be detected by a sensor mounted on a fixed structure of the elevator shaft or equivalent.

It is further obvious that, although the flexible element in the figures is a rope, it could also be some other corresponding element, such as e.g. a belt, wire, band, chain or a set of ropes. The rope is preferably made of metal, but it may also be made of some other material, such as e.g. rubber. It is also obvious that the flexible element can also be used in other types of activation arrangement than those presented in the figures. Activation of a stopper may also be effected by means of a flexible element in an arrangement where a stopper tending to switch to the activated position by the action of a spring or gravity is kept in the inactivated state by a flexible element temporarily immovably locked in the elevator shaft. In this case, releasing the flexible element from the locked state activates the stopper. Activation of a stopper could also be effected by means of a flexible element in an arrangement utilizing a prior-art switch to alternately activate or inactivate the stopper every time the rope is pulled at. It is also obvious that, although the solutions presented describe swivelable stoppers, the flexible element could be connected to a shiftable element so that longitudinal motion of the flexible element relative to the elevator shaft is converted by a prior-art construction into transverse motion of the shiftable element. The stopper could thus move horizontally back and forth between positions I and II. This provides inter alia the advantage that the direction of motion of the elevator car has no effect on the structure of the stopper arrangement. It is also obvious that the elevator car may be provided with a smaller or larger number of stoppers than suggested by the figures.

The invention claimed is:

1. An elevator arrangement, comprising:

an elevator car arranged to move in an elevator shaft;

an element which is disposed in the elevator shaft and is rotatably shiftable between an activated state and an inactivated state;

a limiter located in the elevator shaft adjacent the shiftable element; and an activating device configured to shift the element between the activated and inactivated states, wherein said activating device comprises a flexible element selected from a group consisting of a rope, a belt, an elongated wire, a band, and a chain movably attached to a fixed structure of the elevator shaft, the flexible element being physically and continuously connected to the shiftable element in a manner permitting the shiftable element to be shifted by means of the flexible element, wherein, when the shiftable element is in the activated state, the shiftable element is positioned to contact the elevator car to prevent upward travel of the elevator car, wherein, when the shiftable element is in the inactivated state, the shiftable element is positioned to not contact the elevator car so as not to impede upward travel of the elevator car, and wherein the limiter is positioned so as to prevent over rotation of the shiftable element.

2. The elevator arrangement according to claim 1, wherein the shiftable element is a mechanical stopper arranged to be moved transversely relative to the elevator shaft between an activated position, at which position the mechanical stopper is in alignment with a stopper attached to the elevator car as seen in the direction of motion of the elevator car, and an inactivated position, at which position the mechanical stopper is out of alignment with the stopper attached to the elevator car.

3. The elevator arrangement according to claim 2, wherein the stopper attached to the elevator car is a stopper for activating a safety gear.

4. The elevator arrangement according to claim 1, wherein the shiftable element is in the activated state in a first position and in the inactivated state in a second position, the second position being different from the first position, between which first and second positions the shiftable element is arranged to be shifted by moving the shiftable element by means of the flexible element.

5. The elevator arrangement according to claim 1, wherein the shiftable element is a mechanical stopper.

6. The elevator arrangement according to claim 1, wherein the shiftable element is a safety switch.

7. The elevator arrangement according to claim 1, wherein, when the shiftable element is in the activated state, the arrangement forms a temporary safety space in a part of the elevator shaft at at least one of an upper and a lower end thereof.

8. The elevator arrangement according to claim 1, wherein the flexible element is disposed in the elevator shaft such that the flexible element extends in the traveling direction of the elevator car through a distance corresponding to at least one floor-to-floor distance, and that the shiftable element is a mechanical stopper arranged to be shifted between states by moving the mechanical stopper transversely relative to the elevator shaft between the activated position, at which the mechanical stopper is in alignment with a stopper attached to the elevator car as seen in the direction of motion of the elevator car, and the inactivated position, at which the mechanical stopper is out of alignment with the stopper attached to the elevator car, by means of the flexible element.

9. The elevator arrangement according to claim 1, wherein the flexible element is disposed in the elevator shaft such that the flexible element extends in the traveling direction of the elevator car through a distance corresponding to at least one floor-to-floor distance.

10. The elevator arrangement according to claim 1, wherein the flexible element is connected to a number of shiftable elements so as to allow the shiftable elements to be shifted simultaneously between the activated state and the inactivated state.

11. The elevator arrangement according to claim 1, wherein the flexible element is passed around at least one idle wheel.

12. The elevator arrangement according to claim 1, wherein the shiftable element includes a first shiftable element and a second shiftable element, and wherein the flexible element passes around an idle wheel, and a portion of the flexible element on a first side of said idle wheel is connected to the first shiftable element and a portion of the flexible element on a second side of said idle wheel is connected to the second shiftable element.

13. The elevator arrangement according to claim 1, wherein at least a portion of the activating device is attached to a guide rail in the elevator shaft.

14. The elevator arrangement according to claim 1, wherein the flexible element is arranged to run at a close distance from at least one of the landing doors at a distance of below a vertical edge of the landing door opening to make it possible to move the flexible element manually via an opened landing door.

15. An elevator arrangement, comprising:

an elevator car arranged to move in an elevator shaft;

an element which is disposed in the elevator shaft and is shiftable between an activated slate and an inactivated state; and an activating device configured to shift the element between the activated and inactivated states, wherein said activating device comprises a flexible element selected from a group consisting of a rope, a belt, an elongated wire, a band, and a chain movably attached to a fixed structure of the elevator shaft, the flexible element being physically and continuously connected to the shiftable element in a manner permitting the shiftable element to be shifted by means of the flexible element, wherein, when the shiftable element is in the activated state, the shiftable element is positioned to contact the elevator car, wherein, when the shiftable element is in the inactivated state, the shiftable element is positioned to not contact the elevator car, and wherein the flexible element passes around an idle wheel, and a portion of the flexible element on a first side of the idle wheel and a portion of the flexible element on a second side of the idle wheel are attached to an element swivelably mounted on a fixed structure of the elevator shaft.

16. A method in elevator maintenance for an elevator having an elevator car in an elevator shaft, the method comprising a step of shifting at least one rotatably shiftable element comprised in the elevator between an inactivated state and an activated state in order to provide a safety space at least in a part of the elevator shaft, wherein, in the step of shifting, the shiftable element is shifted by means of a flexible element selected from the group consisting of a rope, a belt, an elongated wire, a band, and a chain, the flexible element being physically and continuously connected to the shiftable element, and wherein, when the shiftable element is in the activated state, the shiftable element is positioned to contact the elevator car to prevent upward travel of the elevator car, wherein, when the shiftable element is in the inactivated state, the shiftable element is positioned to not contact the elevator car so as not to impede upward travel of the elevator car, and wherein a limiter is positioned in the elevator so as to prevent over rotation of the shiftable element.

17. The method according to claim 16, wherein the flexible element is so disposed in the elevator shaft such that it extends in the traveling direction of the elevator car through a distance corresponding to at least one floor-to-floor distance, and the shiftable element is a mechanical stopper which is shifted between states by moving the mechanical stopper transversely relative to the elevator shaft between an activated position, at which the mechanical stopper is in alignment with a stopper attached to the elevator car as seen in the direction of motion of the elevator car, and an inactivated position, at which the mechanical stopper is out of alignment with the stopper attached to the elevator car by means of the flexible element.

18. The method according to claim 16, wherein the flexible element is so disposed in the elevator shaft such that it extends in the traveling direction of the elevator car through a distance corresponding to at least one floor-to-floor distance.

19. The method according claim 16, wherein, in the method, the shiftable element is shifted by means of the flexible element by moving the flexible element from a distance corresponding to at least one floor-to-floor distance from the shiftable element.

20. A method in elevator maintenance, in which at least one rotatably shiftable element comprised in the elevator is shifted between an inactivated state and an activated state in order to provide a safety space at least in a part of the elevator shaft, wherein the shiftable element is shifted by means of a flexible element and the method uses the elevator arrangement of claim 1.

* * * * *